US010182302B2

(12) United States Patent
Moon et al.

(10) Patent No.: US 10,182,302 B2
(45) **Date of Patent: *Jan. 15, 2019**

(54) BINAURAL DECODER TO OUTPUT SPATIAL STEREO SOUND AND A DECODING METHOD THEREOF

(71) Applicant: SAMSUNG ELECTRONICS CO., LTD., Suwon-si (KR)

(72) Inventors: Han-gil Moon, Seoul (KR); Sun-min Kim, Yongin-si (KR); In-gyu Chun, Yongin-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/698,258

(22) Filed: Sep. 7, 2017

(65) Prior Publication Data

US 2018/0070190 A1 Mar. 8, 2018

Related U.S. Application Data

(63) Continuation of application No. 14/752,377, filed on Jun. 26, 2015, now Pat. No. 9,800,987, which is a (Continued)

(30) Foreign Application Priority Data

Jun. 5, 2006 (KR) ..... 10-2006-0050455

(51) Int. Cl.
*H04S 1/00* (2006.01)
*H04S 7/00* (2006.01)
*H04S 3/00* (2006.01)

(52) U.S. Cl.
CPC ..... *H04S 7/30* (2013.01); *H04S 1/00* (2013.01); *H04S 3/008* (2013.01); (Continued)

(58) Field of Classification Search
CPC .... H04S 1/00; H04S 2400/01; H04S 2420/01; H04S 2420/03; H04S 2420/07; H04S 3/008; H04S 7/30
(Continued)

(56) References Cited

U.S. PATENT DOCUMENTS 7,519,538 B2 4/2009 Villemoes et al.
7,583,805 B2 9/2009 Baumgarte et al.
(Continued)

FOREIGN PATENT DOCUMENTS

JP 2005-128401 A 5/2005
KR 1020060122695 11/2006
(Continued)

OTHER PUBLICATIONS

Bai M. R. et al. "Development and implementation of cross-talk cancellation system in spatial audio reproduction based on subband filtering," Journal of Sound and Vibration, vol. 290, Mar. 7, 2006.
Breebaart et al. "MPEG Spatial Audio Coding/MPEG Surround: Overview and Current Status," Proc. 119th AES Convention. New York, Oct. 2005.
Korean Notice of Allowance dated Jul. 23, 2007 issued in KR Application No. 10-2006-0050455.

(Continued)

*Primary Examiner* — Paul S Kim
*Assistant Examiner* — Friedrich W Fahnert
(74) *Attorney, Agent, or Firm* — Sughrue Mion, PLLC

(57) ABSTRACT

A binaural decoder for an MPEG surround stream, which decodes an MPEG surround stream into a stereo 3D signal, and a decoding method thereof. The method includes dividing a compressed audio stream and head related transfer function (HRTF) data into subbands, selecting predetermined subbands of the HRTF data divided into subbands and filtering the HRTF data to obtain the selected subbands, decoding the audio stream divided into subbands into a stream of multi-channel audio data with respect to subbands according to spatial additional information, and binaural-synthesizing the HRTF data of the selected subbands with the multi-channel audio data of corresponding subbands.

5 Claims, 8 Drawing Sheets

Related U.S. Application Data continuation of application No. 13/588,563, filed on Aug. 17, 2012, now Pat. No. 9,071,920, which is a continuation of application No. 11/682,485, filed on Mar. 6, 2007, now Pat. No. 8,284,946.

(60) Provisional application No. 60/779,450, filed on Mar. 7, 2006.

(52) U.S. Cl.
CPC ..... *H04S 2400/01* (2013.01); *H04S 2420/01* (2013.01); *H04S 2420/03* (2013.01); *H04S 2420/07* (2013.01)

(58) Field of Classification Search
USPC ..... 381/1, 17, 20–23, 61, 80, 98, 119, 303, 381/307, 309, 310; 704/500, 501, 205, 704/211, E19.005, E19.01, E19.018, 704/E19.019; 700/94
See application file for complete search history.

(56) References Cited

U.S. PATENT DOCUMENTS

| | | | |
|---|---|---|---|
| 7,676,374 | B2 | 3/2010 | Tammi |
| 2005/0058304 | A1 | 3/2005 | Baumgarte et al. |
| 2005/0249272 | A1 | 11/2005 | Kirkeby et al. |
| 2006/0050909 | A1 | 3/2006 | Kim et al. |
| 2006/0153408 | A1 | 7/2006 | Faller et al. |
| 2006/0198542 | A1 | 9/2006 | Benjelloun Touimi et al. |
| 2007/0160219 | A1 | 7/2007 | Jakka et al. |
| 2007/0162278 | A1 | 7/2007 | Miyasaka et al. |
| 2009/0119110 | A1 | 5/2009 | Oh et al. |
| 2009/0150161 | A1 | 6/2009 | Faller |
| 2009/0225991 | A1 | 9/2009 | Oh et al. |

FOREIGN PATENT DOCUMENTS

| | | | |
|---|---|---|---|
| WO | 9949574 | A1 | 9/1999 |
| WO | 2004/093495 | A1 | 10/2004 |
| WO | 2006014449 | | 2/2006 |

BINAURAL DECODER TO OUTPUT SPATIAL STEREO SOUND AND A DECODING METHOD THEREOF

CROSS-REFERENCE TO RELATED APPLICATIONS

This application is a Continuation Application of prior application Ser. No. 14/752,377 filed on Jun. 26, 2015 in the United States and Patent and Trademark Office, which is a Continuation Application of prior application Ser. No. 13/588,563 filed on Aug. 17, 2012 in the United States and Patent and Trademark Office (now U.S. Pat. No. 9,071,920), which is a Continuation of prior application Ser. No. 11/682,485, filed on Mar. 6, 2007 in the United States Patent and Trademark Office (now U.S. Pat. No. 8,284,946), which claims priority under 35 U.S.C. §§ 120 and 119(a) from U.S. Provisional Application No. 60/779,450, filed on Mar. 7, 2006, in the US PTO, and Korean Patent Application No. 10-2006-0050455, filed on Jun. 5, 2006, in the Korean Intellectual Property Office, the disclosures of which are incorporated herein in their entireties by reference.

BACKGROUND OF THE INVENTION

1. Field of the Invention

The present general inventive concept relates to a moving picture experts group (MPEG) surround system, and more particularly, to an MPEG surround binaural decoder to decode an MPEG surround stream into a 3-dimensional (3D) stereo signal, and a decoding method thereof.

2. Description of the Related Art

In general, an MPEG surround system compresses multi-channel audio data having N channels into multi-channel audio data having M channels (M<N), and uses additional information, to restore the compressed audio data again to the multi-channel audio data that has N channels.

A technology related to this MPEG surround system is disclosed in WO 2006/014449 A1 (PCT/US2005/023876), filed on 5 Jul. 2005, entitled CUED-BASED AUDIO CODING/DECODING.

FIG. 1 is a block diagram illustrating a conventional MPEG surround system. Referring to FIG. 1, an encoder 102 includes a downmixer 106 and a binaural cue coding (BCC) estimation unit 108. The downmixer (e.g. "downmix C-to-E) 106 transforms input audio channels (Xi(n)) into audio channels (yi(n)) to be transmitted. The BCC estimation unit 108 divides the input audio channels (Xi(n)) into time-frequency blocks, and extracts additional information existing between channels in each block, i.e., an inter-channel time difference (ICTD), an inter-channel level difference (ICLD), and an inter-channel correlation (ICC).

Accordingly, the encoder 106 downmixes multi-channel audio data having N channels into multi-channel audio data having M channels, and transmits the audio data together with additional information to a decoder 104.

The decoder 104 uses downmixed audio data and additional information to restore the multi-channel audio data having N channels.

In the conventional MPEG surround system as illustrated in FIG. 1, an MPEG surround stream is decoded into multi-channel audio data with 5.1 or more channels. Accordingly, a multi-channel speaker system is required to reproduce this multi-channel audio data.

However, it is difficult for a mobile device to have a multi-channel speaker system. Accordingly, the mobile device cannot reproduce the MPEG surround system effectively.

SUMMARY OF THE INVENTION

The present general inventive concept provides a binaural decoder which provides a 3-dimensional (3D) MPEG surround service in a stereo environment, by performing binaural synthesis of an optimum bandwidth of a head related transfer function (HRTF) by using a quadrature mirror filter (QMF), and a decoding method thereof.

The present general inventive concept also provides an MPEG surround system to which the binaural decoding method is applied.

Additional aspects and utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing a method of decoding a compressed audio stream into a stereo sound signal, the method including dividing a compressed audio stream and head related transfer function (HRTF) data into subbands, selecting subbands of predetermined bands of the HRTF data divided into subbands and filtering the HRTF data to obtain the selected subbands, decoding the audio stream divided into subbands into a stream of multi-channel audio data with respect to subbands according to spatial additional information, and binaural-synthesizing the HRTF data of the selected subbands with the multi-channel audio data of corresponding subbands.

The foregoing and/or other aspects and utilities of the present general inventive concept may also be achieved by providing a binaural decoding apparatus to binaurally decode a compressed audio stream, the binaural decoding apparatus including a subband analysis unit to analyze each of the compressed audio stream and head related transfer function (HRTF) data with respect to subbands, a subband filter unit to select subbands of predetermined bands of the HRTF data analyzed in the subband analysis unit and to filter the HRTF data to obtain the selected subbands, a spatial synthesis unit to decode the audio stream analyzed in the subband analysis unit into a stream of multi-channel audio data with respect to subbands according to spatial additional information, a binaural synthesis unit to binaural-synthesize the HRTF data of the subbands obtained when the subband filter unit filters corresponding subbands of the stream of multi-channel audio data that are decoded in the spatial synthesis unit, and a subband synthesis unit to subband-synthesize audio data output with respect to subbands from the binaural synthesis unit.

The foregoing and/or other aspects and utilities of the present general inventive concept may also be achieved by providing an MPEG surround system, including a decoder to analyze each of a generated audio stream and preset HRTF data with respect to subbands, to select and filter the HRTF data to obtain one or more of the subbands of predetermined HRTF bands of the HRTF data analyzed with respect to the subbands, to decode the analyzed audio stream analyzed into a stream of multi-channel audio data with respect to the subbands according to spatial additional information, to binaural-synthesize the HRTF data of the obtained subbands and the decoded multi-channel audio data, and to subband-synthesize a stream of audio data output with respect to the subbands.

The decoder may include a subband filter unit to select one or more of the subbands of the HTRF data analyzed in the subband analysis unit and to filter the HRTF data to obtain the obtained subbands, a spatial synthesis unit to decode the audio stream analyzed in the subband analysis unit into a stream of multi-channel audio data with respect to the subbands of the audio stream according to spatial additional information, and a binaural synthesis unit to binaural-synthesize the HRTF data of the subbands obtained by filtering in the subband filter unit with the corresponding subbands of the stream of multi-channel audio data decoded in the spatial synthesis unit.

The foregoing and/or other aspects and utilities of the present general inventive concept may also be achieved by providing a mobile device having an MPEG surround system, including a decoder including an analysis unit to divide an audio stream and HRTF data with respect to subbands, a subband filter unit to filter the HRTF data to obtain one or more of the subbands of the HRTF data, a spatial synthesis unit to decode the divided audio stream into a stream of multi-channel audio data with respect to the subbands according to spatial information, and a binaural-synthesis unit to binaural-synthesize the HRTF data of the obtained one or more subbands with the corresponding subbands of the stream of multi-channel audio data.

The apparatus may further comprise a subband-synthesis unit to output audio data with respect to the subbands from the binaural synthesis unit.

The foregoing and/or other aspects and utilities of the present general inventive concept may also be achieved by providing a method of producing an MPEG surround sound in a mobile device, the method including generating an audio stream and channel additional information, the audio stream obtained by downmixing a plurality of channels of MPEG audio data into a predetermined number of channels, analyzing each of the generated audio stream and preset HRTF data with respect to subbands, selecting and filtering the HRTF data to obtain one or more of the subbands of predetermined HRTF bands of the HRTF data analyzed with respect to the subbands, decoding the analyzed audio stream analyzed into a stream of multi-channel audio data with respect to the subbands according to spatial additional information, binaural-synthesizing the HRTF data of the obtained one or more subbands and the decoded multichannel audio data, and subband-synthesizing a stream of audio data output with respect to the subbands.

The foregoing and/or other aspects and utilities of the present general inventive concept may also be achieved by providing a method of producing an MPEG surround sound in a mobile device, the method including analyzing each of a generated audio stream and preset HRTF data with respect to subbands, selecting and filtering the HRTF data to obtain one or more of the subbands of predetermined HRTF bands of the HRTF data analyzed with respect to the subbands, decoding the analyzed audio stream analyzed into a stream of multi-channel audio data with respect to the subbands according to spatial additional information, binaural-synthesizing the HRTF data of the obtained subbands and the decoded multi-channel audio data, and subband-synthesizing a stream of audio data output with respect to the subbands.

The foregoing and/or other aspects and utilities of the present general inventive concept may also be achieved by providing a computer readable recording medium having embodied thereon a computer program to execute a method, wherein the method includes generating an audio stream and channel additional information, the audio stream obtained by downmixing a plurality of channels of MPEG audio data into a predetermined number of channels, analyzing each of the generated audio stream and preset HRTF data with respect to subbands, selecting and filtering the HRTF data to obtain one or more of the subbands of predetermined HRTF bands of the HRTF data analyzed with respect to the subbands, decoding the analyzed audio stream analyzed into a stream of multi-channel audio data with respect to the subbands according to spatial additional information, binaural-synthesizing the HRTF data of the obtained one or more subbands and the decoded multi-channel audio data, and subband-synthesizing a stream of audio data output with respect to the subbands.

The foregoing and/or other aspects and utilities of the present general inventive concept may also be achieved by providing a computer readable recording medium having embodied thereon a computer program to execute a method, wherein the method includes analyzing each of a generated audio stream and preset HRTF data with respect to subbands, selecting and filtering the HRTF data to obtain one or more of the subbands of predetermined HRTF bands of the HRTF data analyzed with respect to the subbands, decoding the analyzed audio stream analyzed into a stream of multi-channel audio data with respect to the subbands according to spatial additional information, binaural-synthesizing the HRTF data of the obtained subbands and the decoded multi-channel audio data, and subband-synthesizing a stream of audio data output with respect to the subbands.

The foregoing and/or other aspects and utilities of the present general inventive concept may also be achieved by providing a binaural decoding apparatus, including a spatial synthesis unit to decode first and second audio streams into streams of multi-channel audio data with respect to subbands according to spatial parameters, a binaural synthesis unit including multipliers to convolute the streams of multi-channel audio data with HTRF data, and downmixers to downmix the convoluted streams of multi-channel audio data through a linear combination and output the convoluted streams of multi-channel audio data a result as left and right channel audio signals, a first QMF synthesis unit to subband-synthesize the left audio channel and to output the result to a left speaker, and a second QMF synthesis unit to subband-synthesize the right audio channel and to output the result to a right speaker.

The foregoing and/or other aspects and utilities of the present general inventive concept may also be achieved by providing a binaural decoding apparatus, including a sub-band filter unit to select one or more of subbands of HRTF data, and a binaural synthesis unit to convolute an in-band stream of multi-channel audio data with the HRTF data of the selected one or more subbands, and to down-mix the multiplied in-band stream and an out-of-band stream of the multi-channel audio data into two-channel audio data.

The multi-channel audio data may include a plurality of channels divided into subbands, the subbands being divided into the in-band and the out-of-band, and the channels included in the subbands of the in-band being multiplied with the HRTF data of corresponding ones of the selected one or more subbands.

The foregoing and/or other aspects and utilities of the present general inventive concept may also be achieved by providing a method of decoding a compressed audio stream into a stereo sound signal, including dividing a compressed audio stream and head related transfer function (HRTF) data into subbands, decoding the divided audio stream into a stream of multi-channel audio data with respect to the subbands according to spatial additional information, and binaural-synthesizing the HRTF data of the subbands with the stream of multi-channel audio data of corresponding subbands.

The method may further include selecting the subbands of one or more predetermined bands of the HRTF data by filtering the HRTF data.

The foregoing and/or other aspects and utilities of the present general inventive concept may also be achieved by providing a method of decoding a compressed audio stream into a stereo sound signal, including dividing a compressed audio stream into subbands, decoding the divided audio stream into a stream of multi-channel audio data with respect to the subbands according to spatial additional information, and binaural-synthesizing a predetermined HRTF data with the stream of multi-channel audio data of corresponding subbands.

The foregoing and/or other aspects and utilities of the present general inventive concept may also be achieved by providing a binaural decoding apparatus to binaurally decode a compressed audio stream, including a subband analysis unit to analyze each of the compressed audio stream and head related transfer function (HRTF) data with respect to subbands, a spatial and binaural synthesis unit to decode the audio stream analyzed in the subband analysis unit into a stream of multi-channel audio data with respect to the subbands according to spatial additional information, and binaural-synthesize the HRTF data of the subbands with the corresponding subbands of the stream of multi-channel audio data decoded in the spatial synthesis unit, and a subband synthesis unit to subband-synthesize audio data output with respect to the subbands from the binaural synthesis unit.

The method may further include a subband filter unit to select one or more of the subbands of predetermined bands of the HRTF data analyzed in the subband analysis unit and to filter the HRTF data to obtain the selected subbands.

The foregoing and/or other aspects and utilities of the present general inventive concept may also be achieved by providing a binaural decoding apparatus to binaurally decode a compressed audio stream, including a subband analysis unit to analyze each of the compressed audio stream and head related transfer function (HRTF) data with respect to subbands, a spatial and binaural synthesis unit to decode the audio stream analyzed in the subband analysis unit into a stream of multi-channel audio data with respect to the subbands according to spatial additional information, and binaural-synthesize a predetermined HRTF data with the corresponding subbands of the stream of multi-channel audio data decoded in the spatial synthesis unit, and a subband synthesis unit to subband-synthesize audio data output with respect to the subbands from the binaural synthesis unit.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
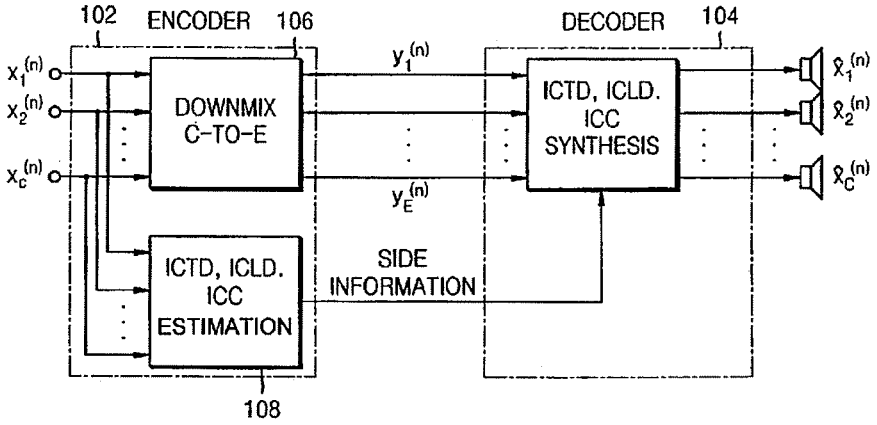
FIG. 1 (PRIOR ART)
FIG. 1 is a block diagram illustrating a conventional MPEG surround system.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

Figure 2:
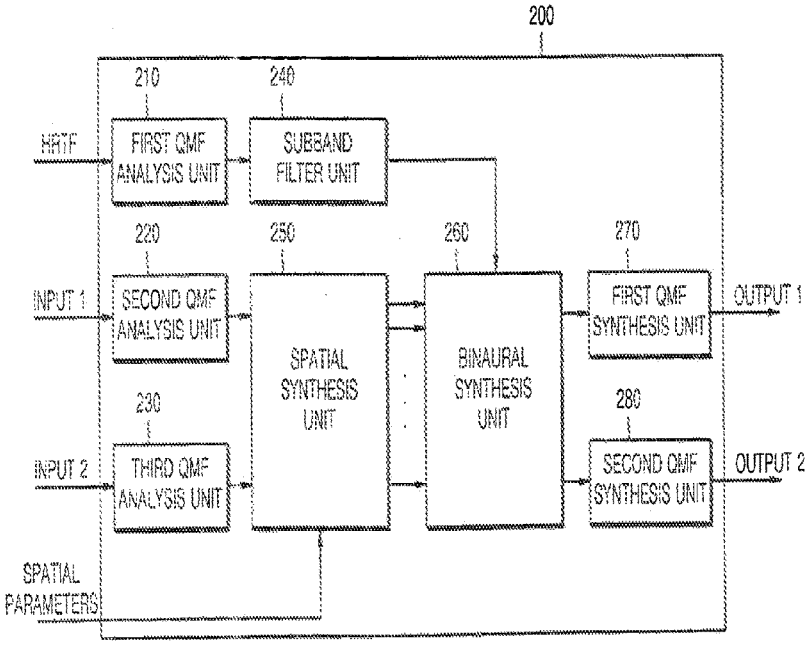
FIG. 2 is a block diagram illustrating a binaural decoder to decode a stereo signal according to an embodiment of the present general inventive concept.

FIG. 2 is a block diagram illustrating a binaural decoder 200 to decode a stereo signal according to an embodiment of the present general inventive concept.

An encoder (not illustrated) generates an audio stream and channel additional information, by downmixing N-channels of audio data into M-channels of audio data.

The binaural decoder 200 of FIG. 2 includes first, second, and third quadrature mirror filter (QMF) analysis units 210, 220, and 230, a subband filter unit 240, a spatial synthesis unit 250, a binaural synthesis unit 260, and first and second QMF synthesis units 270 and 280.

First and second audio signals (input 1, input 2) encoded in the encoder (not illustrated), preset head related transfer function (HRTF) data, and spatial parameters corresponding to additional information are input to the binaural decoder 200. At this time, the spatial parameters are channel-related additional information, such as a channel time difference (CTD), a channel level difference (CLD), an inter-channel correlation (ICC), and a channel prediction coefficient (CPC).

Also, the HRTF is a function obtained by mathematically modeling a path through which sound is transferred from a sound source to an eardrum of an ear of a listener. A characteristic of the HRTF varies with respect to a positional relation between a sound and the listener. The HRTF is a transfer function on a frequency plane that indicates propagation of the sound from the sound source to the ear of the listener, and a characteristic function which reflects frequency distortion occurring at a head, ear lobe and torso of the listener. Binaural synthesis reproduces a sound recorded at the two ears of a dummy-head imitating the shape of a human head by using this HRTF, to headphones or earphones. Accordingly, by the binaural synthesis causes the listener to experience a realistic stereo sound field, as can be experienced in a studio recording environment.

The first QMF analysis unit 210 transforms the HRTF data in a time domain into data in a frequency domain, and divides the HRTF data with respect to subbands suitable for a frequency band of an MPEG surround stream.

The second QMF analysis unit 220 transforms the input first audio stream (input 1) in the time domain into a first audio stream in the frequency domain and divides the stream with respect to the subbands.

The third QMF analysis unit 230 transforms the input second audio stream (input 2) in the time domain into a second audio stream in the frequency domain and divides the stream with respect to the subbands.

The subband filter unit 240 includes a band-pass filter and a subband filter. The subband filter unit 240 selects and filters pass bands that are important to recognition of a directivity effect and a spatial effect, from the HRTF data windowed with respect to the subbands in the first QMF analysis unit 210, and subband-filters the filtered HRTF data in detail with respect to the subbands of the input audio stream. Accordingly, the pass bands of the HRTF important to recognition of the directivity effect and the spatial effect have measurements of 100 Hz~1.5 kHz, 100 Hz~4 kHz, and 100 Hz~8 kHz, which are selectively used with respect to resources of a system. The resources of the system include, for example, an operation speed of a digital signal processor (DSP) or a capacity of a memory of a binaural decoder.

The spatial synthesis unit 250 decodes the first and second audio streams output from the second and third QMF analysis units 220 and 230, respectively, with respect to subbands, into streams of multi-channel audio data with respect to the subbands, by using spatial parameters such as the CTD, CLD, ICC and CPC.

The binaural synthesis unit 260 outputs first and second channel audio data with respect to the subbands, by applying the HRTF data windowed in the subband filter unit 240 to the streams of the multi-channel audio data with respect to the subbands output from the spatial synthesis unit 250.

The first QMF synthesis unit 270 subband-synthesizes, with respect to the subbands, the first channel audio data that is output from the binaural synthesis unit 260.

The second QMF synthesis unit 280 subband-synthesizes, with respect to the subbands, the second channel audio data that is output from the binaural synthesis unit 260.

Figure 3:
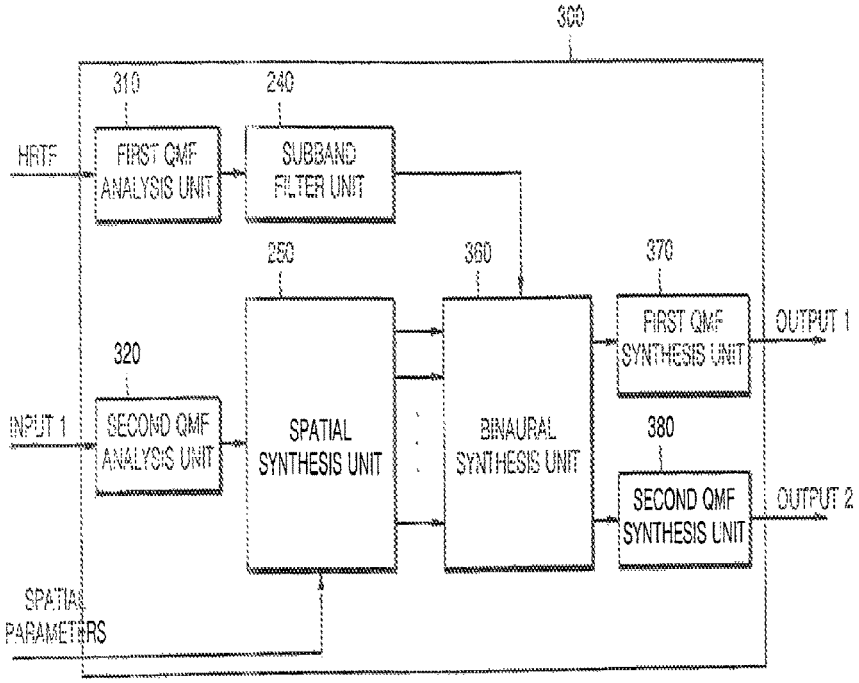
FIG. 3 is a block diagram illustrating a binaural to decode a mono signal according to an embodiment of the present general inventive concept.

FIG. 3 is a block diagram illustrating a binaural decoder to decode a mono signal according to an embodiment of the present general inventive concept.

The binaural decoder 300 of FIG. 3 uses an encoded mono signal instead of a stereo signal as an input signal, which is different from the binaural decoder 200 of FIG. 2.

That is, the functions and structures of first and second QMF analysis units 310 and 320, a subband filter unit 340, a spatial synthesis unit 350, a binaural synthesis unit 360, and first and second QMF synthesis units 370 and 380 may be the same, respectively, as the first and second QMF analysis units 210 and 220, the subband filter unit 240, the spatial synthesis unit 250, the binaural synthesis unit 260, and the first and second QMF synthesis units 270 and 280 of FIG. 2. However, in the current embodiment, a 2-channel signal having a stereo effect is generated using an encoded mono signal.

Figure 4:
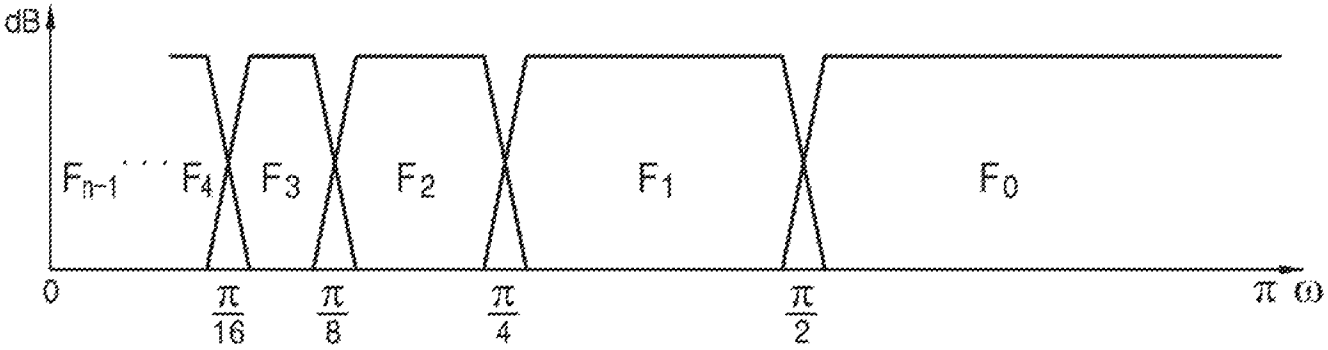
FIG. 4 is a diagram illustrating a subband division performed in first through third QMF analysis units of the binaural decoder of FIG. 2 according to an embodiment of the present general inventive concept.

FIG. 4 is a diagram illustrating a subband division performed in the first through third QMF analysis units 210 through 230 of FIG. 2 according to an embodiment of the present general inventive concept.

Referring to FIGS. 2 and 4, the first through third QMF analysis units 210 through 230 perform division of the input audio streams into a plurality of subbands, i.e., Fo, Fi, F2, F3, F4, Fn−i in a frequency domain. At this time, the subband analysis can use fast Fourier transform (FFT), or discrete Fourier transform (DFT) instead of the QMF. Since the QMF is a well-known technology in the field of MPEG audio, further explanation on the QMF will be omitted.

Figure 5:
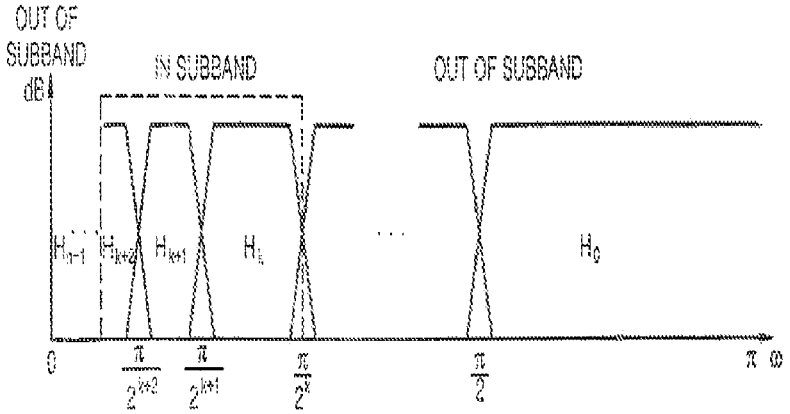
FIG. 5 is a diagram illustrating subband filtering as performed in a subband filter unit of the binaural decoder of FIG. 2 according to an embodiment of the present general inventive concept.

FIG. 5 is a diagram illustrating subband filtering performed in the subband filter unit 240 of FIG. 2 according to an embodiment of the present general inventive concept.

Referring to FIGS. 2 and 5, the subband filter unit 240 selects and filters a subband that is important to recognition of a directivity effect from the HRTF data that is windowed with respect to the subbands in the first QMF analysis unit 210 of FIG. 2. For example, referring to FIG. 5, the subband filter unit 240 sets a k-th band (Hk), a (k+1)-th band (Hk+1), and a (k+2)-th band (Hk+2), as the subbands of the HRTF data that are important to recognition of the directivity effect, and band-pass filters the HRTF data in the frequency domain to allow these subbands, i.e. the set bands (in band), to pass.

Figure 6:
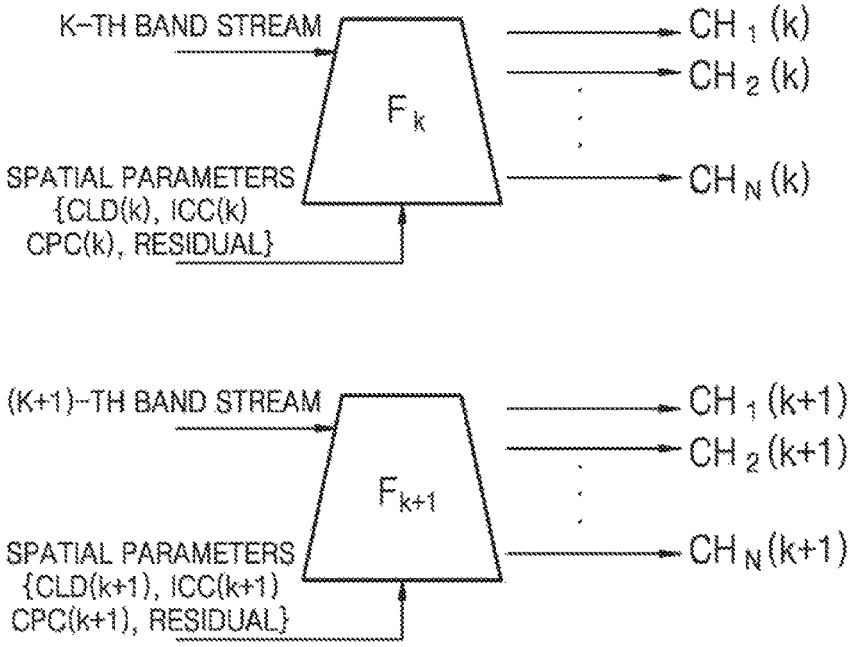
FIG. 6 is a diagram illustrating a spatial synthesis unit of the binaural decoder of FIG. 2 according to an embodiment of the present general inventive concept.

FIG. 6 is a diagram illustrating the spatial synthesis unit 250 of FIG. 2 according to an embodiment of the present general inventive concept.

Referring to FIGS. 2 and 6, the first and second audio streams input with respect to the subbands are decoded into streams of multi-channel audio data with respect to the subbands, by using spatial parameters. For example, a k-th subband (Fk) audio stream is decoded into a stream of audio data having a plurality of channels (CHˆk), ChbCk), . . . CHn(k)), by using the spatial parameters. Also, a (k+1)-th subband (Fk+1) audio stream is decoded into a stream of audio data having a plurality of channels (CHˆk+1), CH2(*k*+1), . . . CHn(k+1)), by using the spatial parameters.

Figure 7:
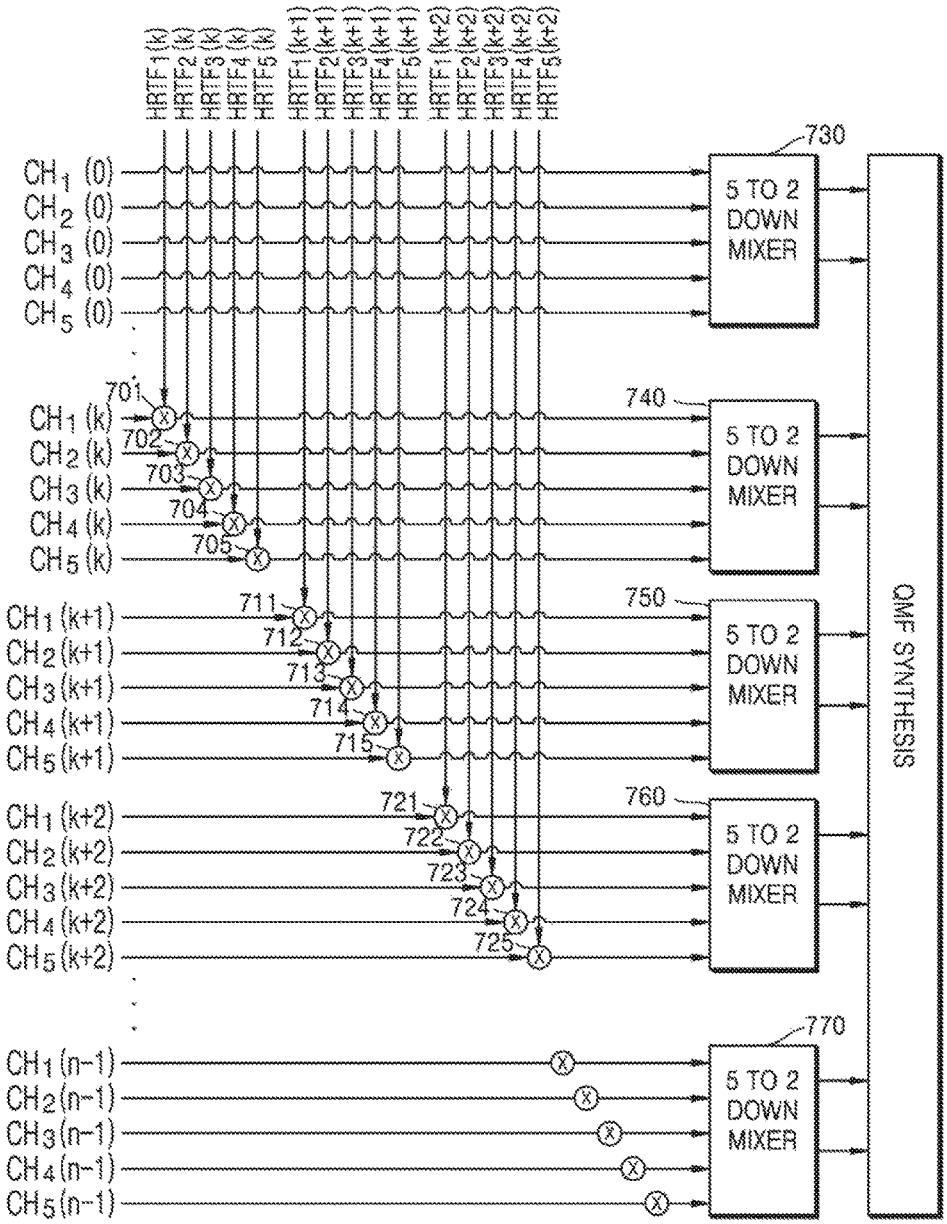
FIG. 7 is a diagram illustrating a binaural synthesis unit of the binaural decoder of FIG. 2 according to an embodiment of the present general inventive concept.

FIG. 7 illustrates the binaural synthesis unit 260 of FIG. 2 according to an embodiment of the present general inventive concept.

Referring to FIGS. 2 and 7, it is assumed that the first audio stream is decoded into a stream of 5-channel audio data and that the subbands of the HRTF are set to a k-th band (Hk), a (k+1)-th band (Hk+1), and a (k+2)-th band (Hk+2).

Multipliers 701 through 705 of the k-th band convolute an input stream of 5-channel audio data (CHˆk), ChbCk), CH3(*k*), CHˆk), CH5(*k*)) of the k-th band with a stream of 5-channel HRTF data (HRTFˆk), HRTFsCk), HRTFsCk), HRTFˆk), HRTFsCk)) of the k-th band.

Multipliers 711 through 715 of the (k+1)-th band convolute an input stream of 5-channel audio data (CHˆk+1), CH2(*k*+1), CH3(*k*+1), CHˆk+1), CH5(*k*+1)) of the k-th band with a stream of 5-channel HRTF data (HRTFˆk+1), HRTF2(*k*+1), HRTFsCk+1), HRTFˆk+1), HRTFsCk+1)) of the (k+1)-th band.

Multipliers 721 through 725 of the (k+2)-th band convolute an input stream of 5-channel audio data (CH1(*k*+2), CH2(*k*+2), CH3(*k*+2), CH4(*k*+2), CH5(*k*+2)) of the (k+2)-th band with a stream of 5-channel HRTF data (HRTF1(*k*+2), HRTF2(*k*+2), HRTF3(*k*+2), HRTF4(*k*+2), HRTF5(*k*+2)) of the (k+2)-th band. Since the (n−1)-th band is out of the subbands as illustrated in FIG. 5, multipliers of the (n−1)-th band do not perform convolution.

Downmixers 730, 740, 750, 760, and 770 downmix the convoluted streams of multi-channel audio data through an ordinary linear combination and output a result as left and right channel audio signals.

The first downmixer 730 downmixes a stream of 5-channel audio data (CH^O), CH2(0), CH3(0), CH4(0), CH5(0)) of the 0-th band into a first stream of 2-channel audio data.

The second downmixer 740 downmixes a stream of 5-channel audio data (CH^k), CH2(*k*), CH3(*k*), CH4(*k*), CH5(*k*)) of the k-th band to which the HRTF of the k-th band has been applied by the k-th band multipliers 701 through 705, into a second stream of 2-channel audio data.

The third downmixer 750 downmixes a stream of 5-channel audio data (CH^k+1), CH2(*k*+1), CHsCk+1), CH4(*k*+1), CHsCk+1)) of the (k+1)-th band to which the HRTF of the (k+1)-th band has been applied by the (k+1)-th band multipliers 711 through 715, into a third stream of 2-channel audio data.

The fourth downmixer 760 downmixes a stream of 5-channel audio data (CH1(*k*+2), CH2(*k*+2), CH3(*k*+2), CH4(*k*+2), CH5(*k*+2)) of the (k+2)-th band to which the HRTF of the (k+2)-th band has been applied by the (k+2)-th band multipliers 721 through 725, into a fourth stream of 2-channel audio data.

The fifth downmixer 770 downmixes a stream of 5-channel audio data (CH^n−1), CH2(*n*−1), CH3(*n*−1), CH4(*n*−1), CH5(*n*−1)) of the (n−1)-th band into a fifth stream of 2-channel audio data.

As a result, the 2 channel audio data output from the downmixers 730, 740, 750, 760, and 770 are subband-synthesized to left and right audio channels, respectively, by the first and second QMF synthesis units 370 and 380 of FIG. 3. The first QMF synthesis unit 370 subband-synthesizes the left audio channel and outputs the result to the left speaker and the second QMF synthesis unit 380 subband-synthesizes the right audio channel and outputs the result to the right speaker.

Figure 8:
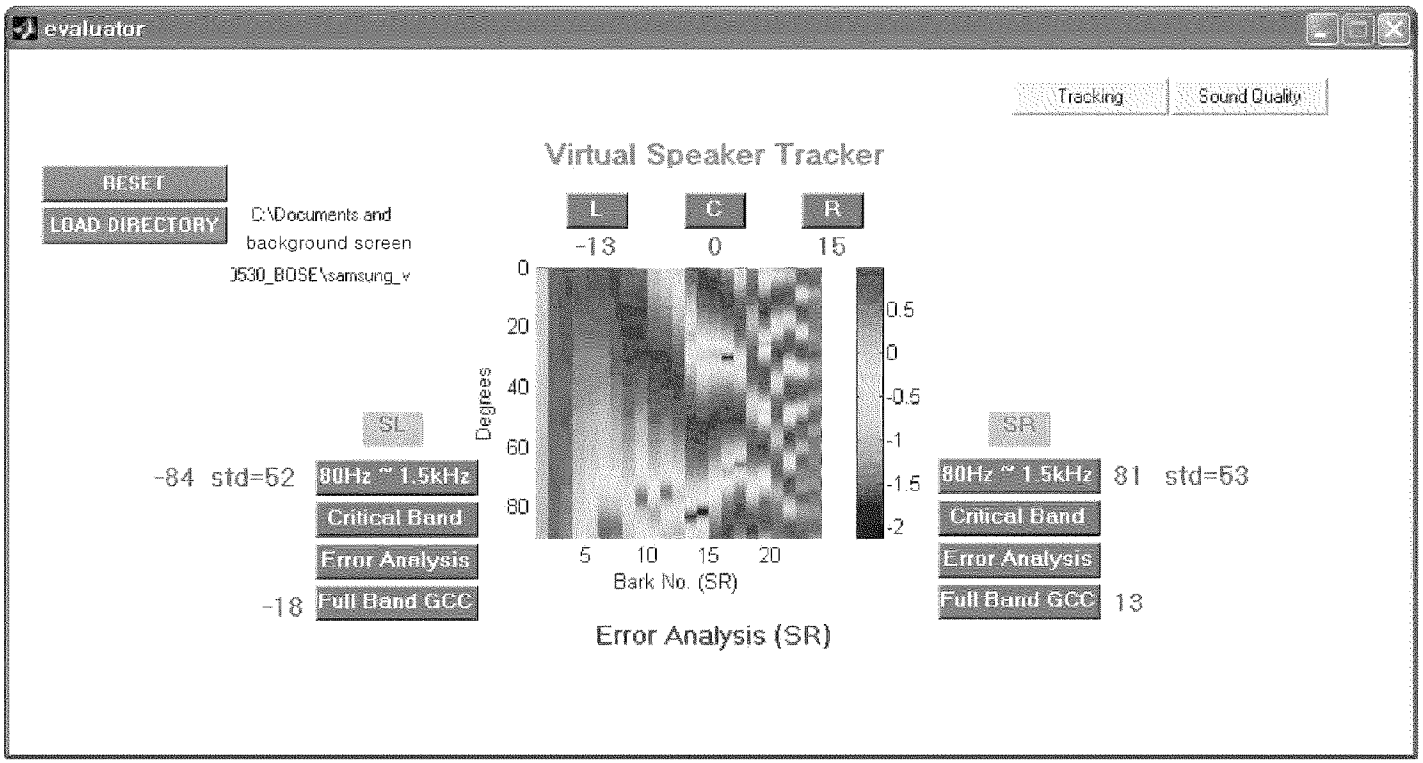
FIG. 8 is a diagram illustrating an emulator to evaluate a bandwidth important to recognition of a directivity effect.

FIG. 8 illustrates an emulator or an evaluator to evaluate a bandwidth important to recognition of a directivity effect.

Referring to FIG. 8, a result of the evaluation of a stereo sound system that uses the emulator illustrates that when binaural synthesis is performed on a horizontal surface, a high frequency region of HRTF does not greatly contribute to actual recognition of a directivity effect. Accordingly, in an environment where resources are limited as in an MPEG surround decoder, the HRTF of a band in which a stereo effect is relatively small compared to the quantity of data, is removed and only a band important to recognition of a directivity effect is filtered and used so that binaural synthesis can be performed more appropriately. Accordingly, 100 Hz~1.5 kHz, 100 Hz~4 kHz, and 100 Hz~8 kHz can be selectively used as effective bands.

The present general inventive concept can also be embodied as computer readable codes on a computer readable recording medium to perform the above-described method. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion.

According to the present general inventive concept as described above, HRTF data is transformed into data in frequency domain and only a band important to recognition of a directivity effect and a spatial effect among the HRTF data is binaural-synthesized. In this way, 3D MPEG surround service can be provided in a stereo environment or a mobile environment.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An apparatus for generating a binaural signal, the apparatus comprising:

a memory and a processor configured to:

generate a quadrature mirror filter (QMF)-domain audio signal by performing a QMF analysis on a time domain audio signal, the QMF domain audio signal comprising a plurality of frequency bands;

generate a QMF-domain impulse response data for binaural by performing a QMF conversion on an impulse response data for binaural; and generate a QMF-domain binaural signal by processing the QMF-domain audio signal based on the QMF-domain impulse response data for binaural according to a predetermined number of bands.

2. The apparatus of claim 1, wherein the QMF-domain impulse response data for binaural is applied to the QMF-domain audio signal based on result of comparing a frequency band of the QMF-domain audio signal with a frequency band for the predetermined number of bands.

3. The apparatus of claim 1, wherein a processing is skipping to apply the QMF-domain impulse response data for binaural to the QMF-domain audio signal having a frequency band higher than a frequency band for the predetermined number of bands.

4. The apparatus of claim 1, wherein the QMF-domain impulse response data for binaural is applied to a part of QMF bands.

5. The apparatus of claim 1, wherein the QMF-domain impulse response data for binaural comprises a head-related transfer function (HRTF).

* * * * *